US008151897B1

(12) United States Patent
Meyer et al.

(10) Patent No.: US 8,151,897 B1
(45) Date of Patent: Apr. 10, 2012

(54) ORDINARY HAZARD EXTENDED COVERAGE SIDEWALL SPRINKLERS AND SYSTEMS

(75) Inventors: Stephen J. Meyer, Malvern, PA (US); George S. Polan, Perkiomenville, PA (US); James E. Golinveaux, North Wales, PA (US)

(73) Assignee: Tyco Fire Products LP, Lansdale, PA (US)

( * ) Notice: Subject to any disclaimer, the term of this patent is extended or adjusted under 35 U.S.C. 154(b) by 0 days.

(21) Appl. No.: 09/196,680

(22) Filed: Nov. 20, 1998

(51) Int. Cl.
*A62C 37/08* (2006.01)

(52) U.S. Cl. ..... 169/41; 169/37; 169/42; 169/57; 239/504; 239/518; 239/524

(58) Field of Classification Search ..... 169/37, 169/38, 39, 40, 41, 42, 56, 57, 70; 239/498, 239/500, 504, 518, 524
See application file for complete search history.

(56) References Cited

U.S. PATENT DOCUMENTS

| | | | | | |
|---|---|---|---|---|---|
| 2,101,694 | A | * | 12/1937 | Tyden | 169/37 X |
| 4,014,388 | A | | 3/1977 | Anderson | |
| 4,296,815 | A | * | 10/1981 | Mears | 169/37 |
| 4,296,816 | A | * | 10/1981 | Fischer | 169/37 |
| H121 | H | * | 9/1986 | Pieczykolan | 169/37 |
| 4,830,117 | A | * | 5/1989 | Capasso | 169/90 |
| 5,609,211 | A | * | 3/1997 | Meyer et al. | 169/37 |
| 5,722,599 | A | | 3/1998 | Fries | 239/504 |
| 5,727,737 | A | * | 3/1998 | Bosio et al. | 239/504 |
| 5,810,263 | A | * | 9/1998 | Tramm | 239/518 |
| 6,367,559 | B1 | * | 4/2002 | Winebrenner | 169/37 |
| 6,520,265 | B2 | * | 2/2003 | Winebrenner | 169/37 |
| 6,889,774 | B2 | * | 5/2005 | Multer et al. | 169/37 |
| 7,137,455 | B2 | * | 11/2006 | Green | 169/37 |

OTHER PUBLICATIONS

Catalog sheet entitled "Horizontal Sidewall Spriklers 140° F. RES/QR-EC & 165° F. RES/QU-EC/EC Model FR-1, Fast Response Solder Type, 17/32" (20 mm) Orifice" TD589, 8 pp., Mar. 1995, Grinnell Corporation, Exeter, NH.

Catalog sheet entitled "Horizontal Sidewall Spinklers RES/QR-EC Model FR-1, Fast Response Solder Type, ½" (15 mm) Orifice" TD588, 8 pp., Mar. 1995, Grinnell Corporation, Exeter, NH.

Catalog sheet entitled "Dry Horizontal Sidewall Spribklers, EC Model F960/Q-48 Designer, ½" Orifice" TD557, 6 pp., Nov. 1992, Grinnell Corporation, Exeter, NH.

(Continued)

*Primary Examiner* — Christopher Kim
(74) *Attorney, Agent, or Firm* — Perkins Coie LLP

(57) ABSTRACT

An extended coverage sidewall automatic fire sprinkler includes a generally tubular body with a central passageway and a central axis. One end of the passageway forms an outlet at one end of the tubular body. A closure at the one end of the tubular body at least essentially generally closes the passageway. A trigger positioned to releasably retain the closure at the outlet closes the passageway. A deflector at a discharge end of the sprinkler is coupled with the tubular body facing and spaced axially away from the outlet and intersects the central axis. The tubular body has a K factor greater than 9. The deflector is shaped and positioned to transform water discharged horizontally from the outlet upon release of the closure by the trigger into a spray pattern of water droplets dispersed over a generally horizontal, generally rectangularly-shaped extended coverage are of more than one hundred square feet located on one side of the sprinkler in an amount and with a distribution effective to control an ordinary hazard fire in the coverage area.

43 Claims, 7 Drawing Sheets

OTHER PUBLICATIONS

Catalog sheet entitled "Automatic Sprinklers, Model F950 Duraspeed Extended Coverage Horizontal Sidewall With Q-45 Deflector" Sec. 5 AS/17, 2 pp., Jan. 1979, Grinnell Fire Protection Systems Company, Inc., Providence, RI.

Catalog sheet entitled "Extended Coverage Horizontal Sidewall Sprinklers Models F950/Q-48 and 1F950/Q-48, Solder Type, 17/32" Orifice", TD548, 4 pp., Sep. 1987, Grinnell Corpration, Exeter, NH.

Catalog sheet entitled "Hor. Sidewall & Recessed Hor. Sidewall Sprinklers Universal Model A QR-EC and EC, 3 & 5 mm Bulb Type, 17/32" (20 mm) Orifice, ¾" NPT**" TD547, 8 pp., May 1996, Grinnell Corporation, Exeter, NH.

Catalog sheet entitled "Extended Coverage Horizontal Sidewall Sprinklers Models F950/Q-48 and 1F950/Q-48, Solder Type, ½Orifice" TD546, 4 pp., Sep. 1987, Grinnell Corpration, Exeter, NH.

Catalog sheet entitled "Hor. Sidewall & Recessed Hor. Sidewall Sprinklers Universal Model A QR-EC and EC, 3 & 5 mm Bulb Type, ½" (15 mm) Orifice, ½" NPT**" TD545, 8 pp., May 1996, Grinnell Corporation, Exeter, NH.

Bulletin No. 219, "Sprinklers, Nozzles and Accessories/Section 4 Grinnell Sidewall Sprinkler, Model F950 Q34, Style: Horizontal Extended Coverage", 2 pp., Aug. 1975, Grinnell Fire Protection Systems Company, Inc., Providence, RI.

Bulletin No. 220, "Sprinklers, Nozzles and Accessories/Section 4 Grinnell Sidewall Sprinkler, Model F 950 Q33, Style: Horizontal Extended Coverage", 2 pp., Aug. 1975, Grinnell Fire Protection Systems Company, Inc., Providence, RI.

Catalog sheet entitled "Dry Horizontal Sidewall Sprinklers Model F960/Q46 Designer, ½" Orifice", TD555, 4 pp., Nov. 1992, Grinnell Corporation, Exeter, NH.

Catalog sheet entitled "Horizontal Sidewall Sprinkler Model F950/Q-46 Solder Type, 1´´/2" Orifice", TD536, 2 pp., Sep. 1987, Grinnell Corporation, Exeter, NH.

Catalog sheet entitled "Hor. Sidewall & Recessed Hor. Sidewall Sprinklers Universal Model A/Q-71 Standard Response, 5 mm Bulb Type, ½" (15 mm) Orifice, 1´´/2" NPT**," TD535M, 5 pp., May 1996, Grinnell Corporation, Exeter, NH.

Catalog sheet entitled "Horizontal Sidewall Sprinklers Model FR-1/Q-46, Fast Response Solder Type, ½" Orifice" TD535, 4 pp., Sep. 1992, Grinnell Corporation, Exeter, NH.

Catalog sheet entitled "Hor. Sidewall & Recessed Hor. Sidewall Sprinklers Universal Model A/Q-71 Quick Response, 3 mm Bulb Type, ½" (15 mm) Orifice, ½" NPT**" TD534, 6 pp., Dec. 1996, Grinnell Corporation, Exeter, NH.

Catalog sheet entitled "Automatic Sprinklers, Model F950 Duraspeed Horizontal Sidewall With Q-31 Deflector, ½" Orifice" Sec. 5 AS/11, 2 pp., 01/979, Grinnell Fire Protection Systems Company, Inc., Providence, RI.

Catalog sheet entitled "Sidewall Sprinkler-H", 4 pp., Aug. 1987, Central Sprinkler Corporation, Lansdale, PA.

Catalog sheet entitled "Sidewall Sprinkler-H 17/32", 4 pp., Aug. 1987, Central Sprinkler Corporation, Lansdale, PA.

Catalog sheet entitled "Sidewall Sprinkler-HF 17/32", 4 pp., Aug. 1987, Central Sprinkler Corporation, Lansdale, PA.

Bulletin HORS-H-1, Rev. No. 4, entitled "Model "H-1" Dry Horizontal Sidewall Sprinkler", 2 pp., Apr. 1986, Central Sprinkler Corporation, Lansdale, PA.

Bulletin HORS-H-1 ADJ, Rev. No. 4, entitled "Model "H-1 Adjustable" Dry Horizontal Sidewall Sprinkler", 2 pp., Apr. 1986, Central Sprinkler Corporation, Lansdale, PA.

* cited by examiner

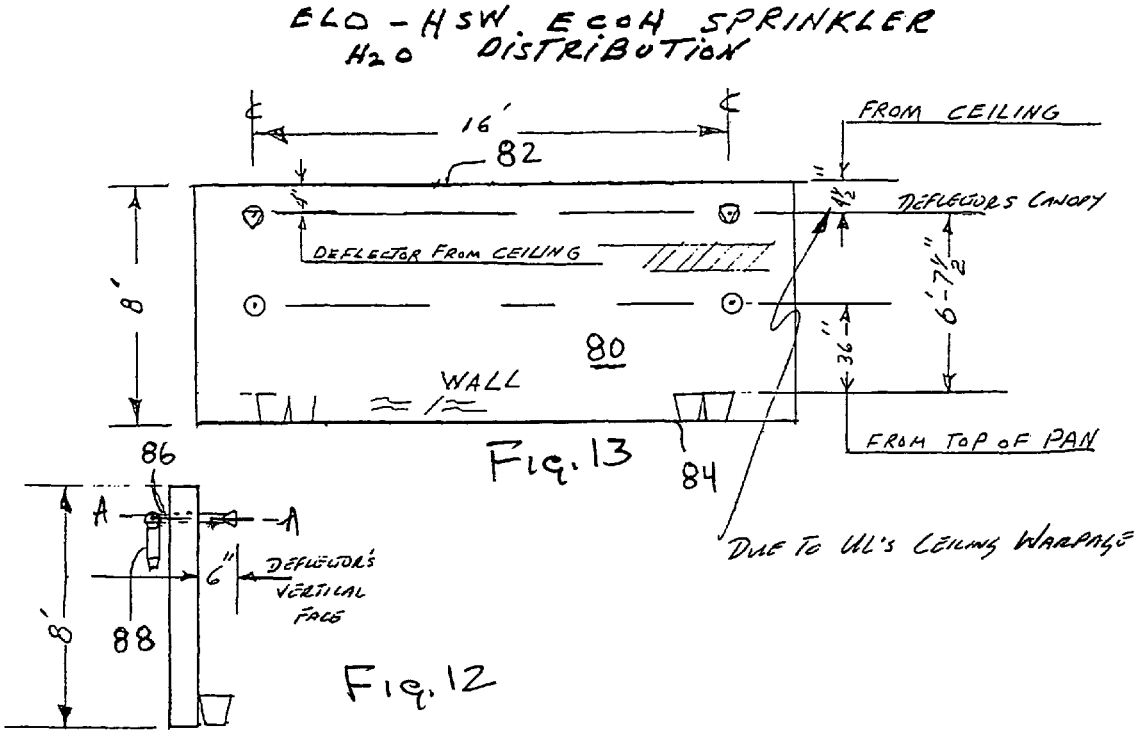
Fig. 13
Fig. 12
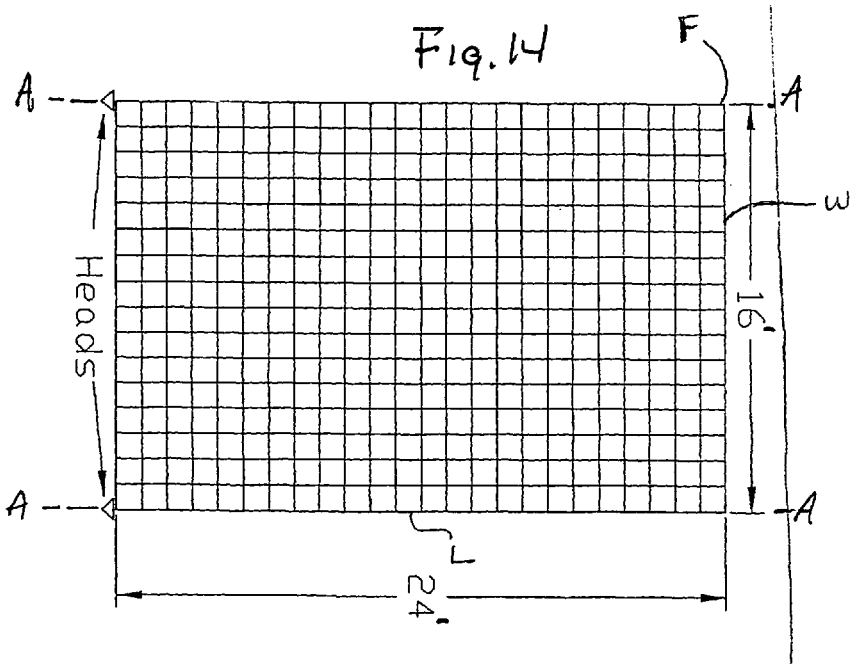
Fig. 14

ORDINARY HAZARD EXTENDED COVERAGE SIDEWALL SPRINKLERS AND SYSTEMS

BACKGROUND OF THE INVENTION

Applicants have demonstrated that it is possible to provide extended coverage ordinary hazard protection using ceiling sprinklers with extra large and larger orifices. Such sprinklers distribute water in a generally symmetrical circular pattern centered on the sprinkler. These sprinklers are disclosed in U.S. Pat. Nos. 5,366,022, 5,664,630, 5,609,211 among others and these three patents are incorporated by reference herein.

Sidewall sprinklers are known which provide extended coverage but only for less demanding light hazard or residential applications. These applications require a sufficiently uniform delivery of water at an average density of 0.10 or less gallons per minute per square foot of area protected. Coverages greater than 100 square feet are considered extended coverages for sidewall sprinklers in ordinary hazard applications. In light hazard and residential applications, extended coverage is anything greater than 96 square feet (14×14).

It is believed that the same advantages provided by extended coverage ordinary hazard ceiling sprinklers could be enjoyed in sidewall sprinkler applications if sufficiently uniform and effective water distribution can be demonstrated for a sidewall sprinkler.

BRIEF SUMMARY OF THE INVENTION

An ordinary hazard extended coverage sidewall automatic fire sprinkler comprising a generally tubular body with a central passageway and a central axis, one end of the passageway forming an outlet at one end of the tubular body, a closure at the one end of the tubular body at least essentially generally closing the passageway, a trigger positioned to releasably retain the closure at the outlet closing the passageway, and a deflector at a discharge end of the sprinkler, the deflector being coupled with the tubular body facing and spaced axially away from the outlet and intersecting the central axis, the tubular body having a K factor greater than 9 and the deflector being shaped and positioned to transform water discharged horizontally from the outlet upon release of the closure by the trigger into a spray pattern of water droplets dispersed over a generally horizontal generally rectangularly-shaped extended coverage area of more that one hundred and up to two hundred and fifty-six square feet located on one side of the sprinkler in an amount and with a distribution effective to control an ordinary hazard fire in the coverage area.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings:

FIG. 12 is a side elevational view of a typical installation of a sidewall sprinkler of the present invention and further illustrating mounting of sprinklers for water distribution testing;

FIG. 13 is a front elevational view of pairs of sidewall sprinklers of the present invention as typically mounted during installation and further illustrating their mounting for water distribution testing; and FIG. 14 is a top plan view of FIG. 13.

DETAILED DESCRIPTION OF THE INVENTION

Figure 1:
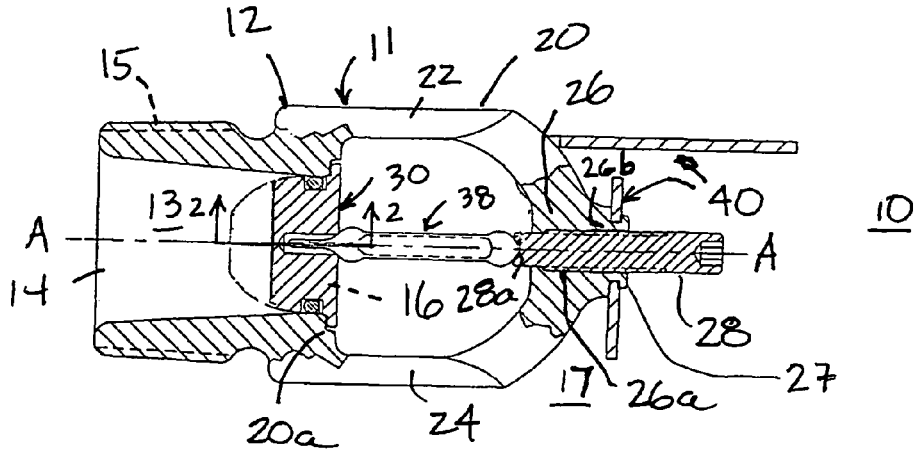
FIG. 1 is a partially broken, side elevation view of a first embodiment ordinary hazard sidewall sprinkler according to the present invention.

In the drawings, like numerals are used to indicate like elements throughout. There is shown in FIG. 1 a first preferred embodiment, extended coverage ordinary hazard sidewall sprinkler of the present invention indicated generally at 10. Sprinkler 10 includes a one-piece frame 11, a closure 30, a trigger 38 and deflector 40. Frame 11 includes a generally tubular body 12 and an adjoining yoke indicated generally 20. Body 12 defines a central passageway 13 having one open end defining an inlet 14 and an opposing open end defining an outlet 16 facing the yoke 20. The sprinkler body 12 may be conventionally provided with external threading indicated schematically by broken lines 15 around the inlet 14 to enable the inlet end to be screwed into a supply pipe (not depicted). Yoke 20 is preferably integrally and monolithically formed formed with the tubular body 12, for example, as a one-piece metal casting, and preferably comprises two mirror-image arms 22 and 24, which extend away from the tubular body 12 on either side of a central axis A-A to a junction or "knuckle" 26. As can be seen from the figures, axis A-A represents a central axis of the inlet 14, outlet 16 and passageway 13 as well as of the tubular body 12 and the yoke 20. It is also a central axis for the water discharged through the outlet 16. Outlet 16 and yoke 20 define a discharge end indicated generally at 17 of the sprinkler 10.

Figure 2:
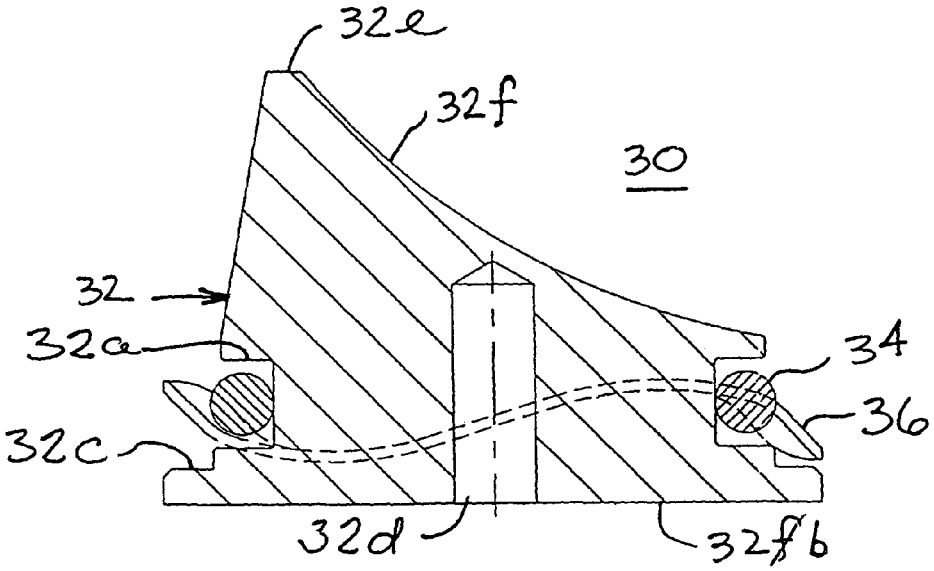
FIG. 2 is a side elevation, cross-section of the closure of the sprinkler of FIG. 1 taken along the lines 2-2 in FIG. 1.

A closure 30 is located at the outlet 16 closing the passageway 13. Closure 30 may or may not be received in or over the passageway 13. Referring to FIG. 2, closure 30 is preferably an assembly which includes an asymmetrically shaped plug 32 having a circumferential, preferably right cylinder shaped groove 32*a* receiving an elastomeric washer or "O-ring" 34 preferably made of silicone. The "top" of the plug 32 extending from the groove 32*a* to a front face 32*b*, which is exposed at the outlet 16 of sprinkler 10, is symmetric and includes a circumferential flange or lip 32*c* forming a step between the groove 32*a*, and face 32*b*. The lip 32*c* is received in a matingly configured annular step 20*a* provided at the outlet 16 end of the tubular body passageway 13. A wave spring or "Belleville" washer 36 is provided around the body 32 and is sized to overlap the annular lip 32*c* to help bias the plug 32 from the outlet 16 when the closure 30 is released. Plug 32 further preferably includes a central bore 32*d* extending inward from the front face 32*b* and an asymmetrically shaped inner end 32*e* extending away from the groove 32*a* in a direction opposite the exposed face 32*b*. The inner end 32*e* has a cupped surface 32*f* asymmetrically positioned with respect to a central axis A-A of the sprinkler 10, which is also a central axis of the closure 30. Cupped surface 32*f* is provided to urge the plug 32 to tumble as the closure 30 leaves the outlet 16 of the tubular body 12 when sprinkler 10 is activated.

Trigger 38 is positioned between the closure 30 and the knuckle 26 of the yoke 20 to retain the closure 30 in the outlet 16 until the sprinkler 10 is activated. Trigger 38 is preferably a thermally responsive, alcohol-filled glass bulb but may be any other suitable, thermally responsive, frangible or releasable device or other suitable, electrically operated release device capable of retaining the closure 30 in position at the outlet 16 until activated by heat or remote control. Such release devices and elements are well known to those of ordinary skill in the art. The depicted trigger/bulb 38 is exemplary only but may, for example, have enlarged longitudinal ends, received in central bore 32*d*, provided in the cent plug 32, and in a depression 28*a* provided in the tip of an adjustment or load screw 28 received in a threaded bore 26*a* passing through knuckle 26 along central axis A-A. Preferred bulbs have temperature ratings between about 155° F. and about 200° F. in nominal sizes (widths) of 3 mm. See U.S. Pat. Nos. 5,829,532 and 4,796,710, incorporated by reference herein. Such bulbs can be obtained from Job GmbH of Germany.

Sprinkler 10 differs from other prior art, frame-type sidewall sprinklers in the configuration of its deflector 40 and in the size of its passageway 13 or "orifice". Sidewall sprinklers of the present invention use sprinkler bodies with unusually large orifices having higher K factors. The "K factor" of a sprinkler is its discharge coefficient and determines the normal or average amount of water delivered through the passageway of the sprinkler as a function of water pressure supplied at the inlet. As used herein, the discharge coefficient or K factor of a sprinkler equals the flow of water in gallons per minute through the passageway of the sprinkler divided by the square root of the pressure of the water fed into the sprinkler inlet in pounds per square inch gauge. Underwriters Laboratories Inc.'s UL Standard 199 defines a "large orifice" sprinkler as one having a K factor of between 7.4 and 8.2±5%. Sprinklers of the present invention use frames with larger than large orifices. In particular, sprinkler bodies of the present invention have K factors greater than 9, suggestedly between 10 and 14 and preferably between 11 and 12. The depicted frame 11 has a K-factor of 11.5. K-factors are indicated in nominal values but are permitted±5% variation.

The preferred body 12 of sprinkler 10 has a nominal height of about 1.05 inches. Passageway 13 has a maximum diameter at inlet 14 of about 0.77 inches and tapers down to a minimum diameter of about 0.63 inches near the outlet 16 before the central passageway 13 flares to form step 20*a* which accepts and supports the closure 30. The yoke 20 extends more than an inch from the widest part of the passageway 13 at the step 20*a* of outlet 16. The distance between the widest part of the passageway 13 and the facing surface of deflector 40 is about 1.25 inches.

Figure 3:
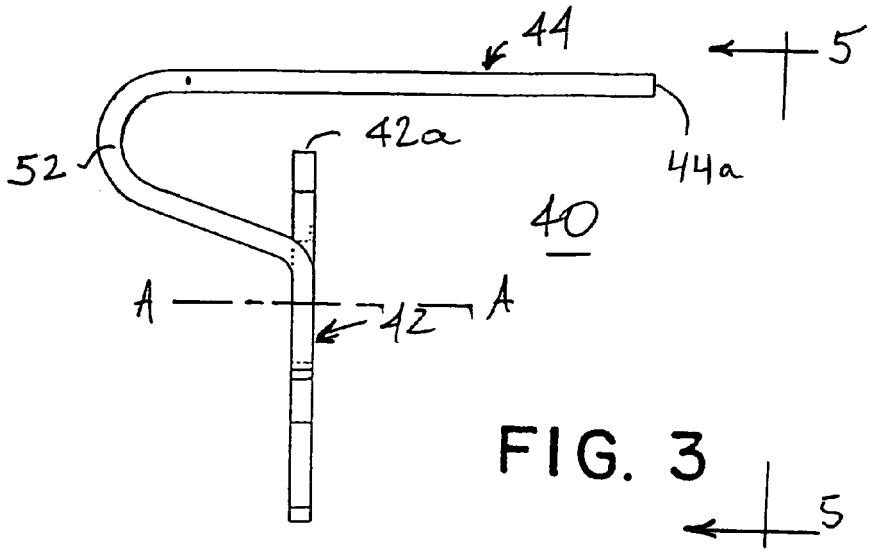
FIG. 3 is a upright side elevational view of the deflector of the sprinkler of FIG. 1 without breakaway and without the sprinkler frame.
Figure 4:
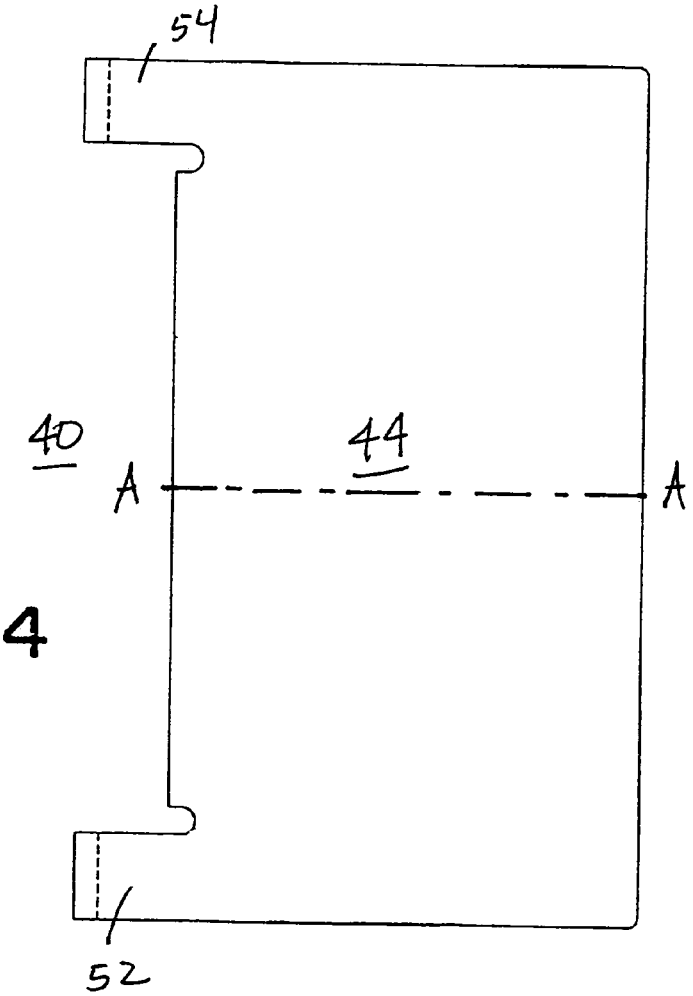
FIG. 4 is a top plan view of the deflector of FIG. 3.
Figure 5:
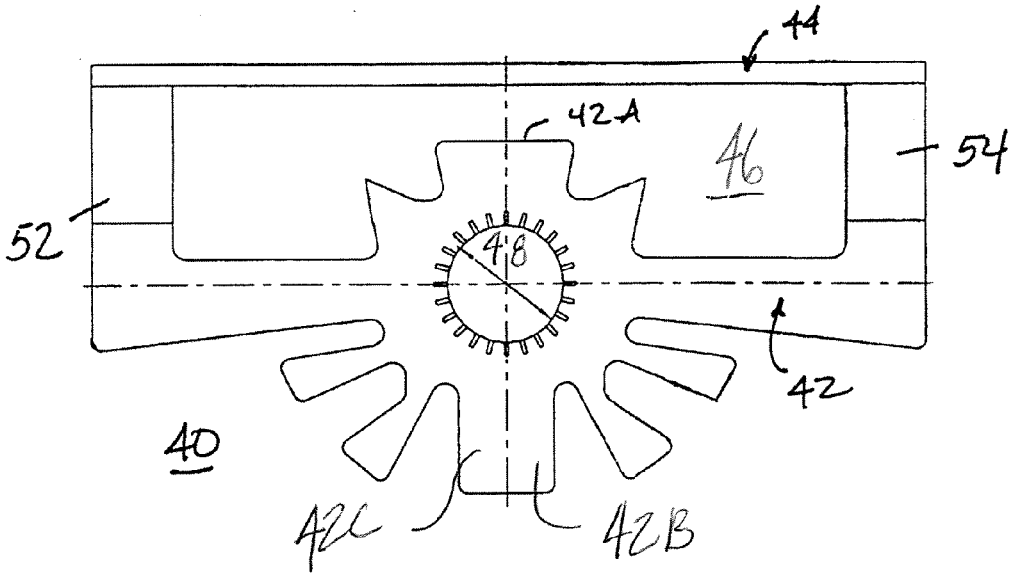
FIG. 5 is a front elevational view of the deflector of FIGS. 3 and 4 taken along the lines 5-5 of FIG. 3.

Deflector 40 is supported from the frame 11 integrally secured with the frame, by being mounted over a boss 26*b* provided at the extreme axial end of the knuckle 26 at the end of yoke 20. Deflector 40 is secured by suitable means such by swaging indicated generally 27 by a nut on a threaded end of the boss (neither depicted). Deflector 40 is shown in varying views in FIGS. 3-5.

Deflector 40 includes a face portion 42, which is supported directly from the arms 22 and 24 through the boss 26*b* on knuckle 26 facing and spaced away from the outlet 16 of the frame body 12. Face portions of sidewall sprinklers of the present invention are at least generally or substantially planar. The preferred face portion 42 is at least essentially planar and is perpendicular to central axis A-A and vertical, when the sprinkler 10 is appropriately installed on a sidewall of a structure with its central axis A-A horizontal.

Deflector 40 further includes a canopy portion 44 extending generally horizontally over the face portion. Canopy portions of deflectors of the present invention are again at least substantially or generally planar and are supported from the face portions, oriented perpendicularly or nearly perpendicularly with respect to the separate vertical planes parallel to the central axis A-A and the face portion 42. As used herein when referring to an angular relation, the term "generally" means±10. The preferred canopy portion 44 is at least essentially planar and is located adjoining but spaced radially outwardly away from and above an upper edge 42*a* of the face portion 42 and is supported by a pair of symmetric curved arms 52 and 54 of the deflector so as to define a single opening 46 of the deflector through which water can pass. Preferably, canopy portion 44 is oriented nearly horizontal when the sprinkler 10 is installed. As will be seen, in some embodiments it may be necessary to pitch the canopy portion with respect to a true horizontal (bubble level) plane so that the far end 44*a* of the canopy portion 44 remote from the tubular body is tilted upwardly away from the central axis A-A and an imaginary horizontal plane along the central axis A-A to provide or permit some rise in discharged liquid.

The imaginary horizontal plane preferably divides the face portion 42 to further define a lower edge 42*b*. The lower edge preferably extends perpendicular to the imaginary vertical plane that symmetrically bisects the deflector 40. The lower edge also preferably extends parallel to the horizontal plane. More preferably, the face portion 42 includes a bottom center 42*c* that is centrally aligned along the vertical plane with the circular opening 48 of the face portion that is engaged about the knuckle 26. The bottom center 42*c* extends below the imaginary horizontal plane so as to locate the lower edge 42*b* as a portion of the deflector 40 most remotely from the horizontal plane.

Figure 6:
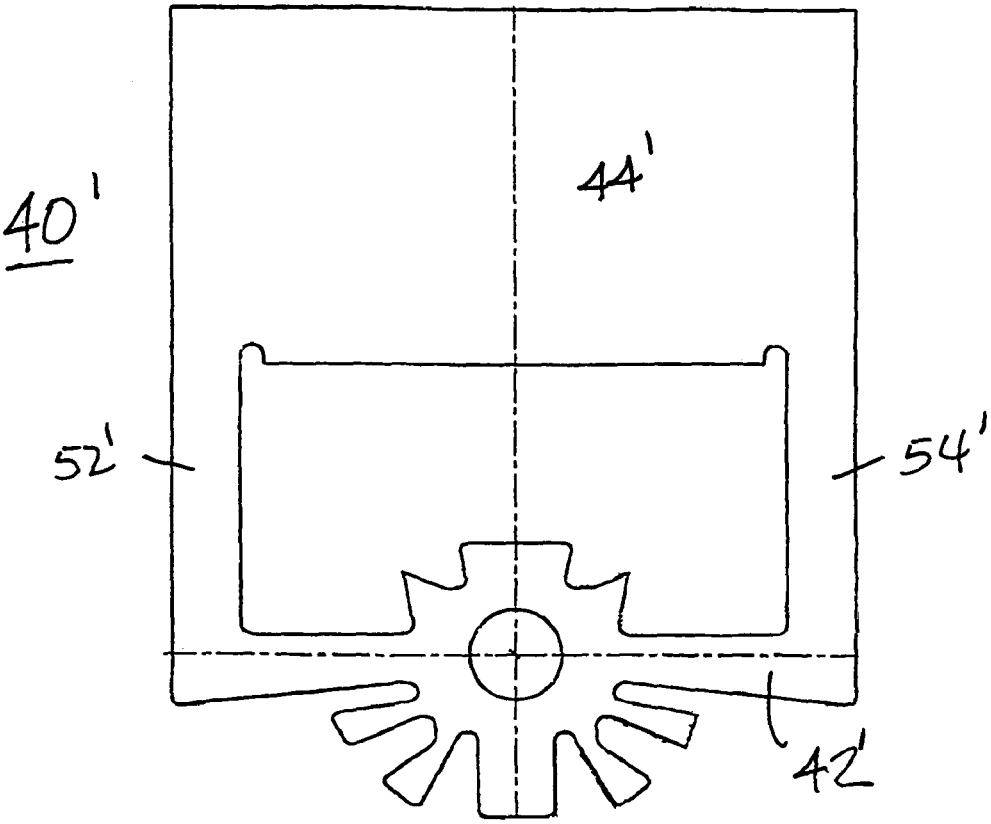
FIG. 6 is a plan view of a planar blank used to form the deflector of FIGS. 3-5.

A planar blank 40', which is bent to form deflector 40 of FIGS. 1 and 3-5, is shown in FIG. 6. Features of the blank 40' which correspond to features in the final deflector 40 are indicated by the same reference numbers with primes. The elements of the deflector 40 and blank 40' are shown to accurate relative scale in the figures. That is while apparent size of deflector 40 may vary from figure to figure, at least with respect to FIGS. 3-6, the relative dimensions and angles of the different portions of the deflector 40 (and blank 40') are accurate. For scale, the width of the canopy 44 is about 2 inches and its axial length over the central axis A-A is about 1.1 inches. Reference is also made to U.S. Pat. No. 5,722,599, which is incorporated by reference herein in its entirety, for details regarding the construction and form of such sidewall deflectors as well as a description of their more detailed features.

Deflector 40 with frame 11 has been shown to be capable of controlling ordinary hazard fires over rectangular extended coverage areas of more that one-hundred and up to 320 (16× 20) square feet by being able to deliver a sufficiently uniform distribution of water over that area where such water is supplied to the sprinkler 10 at a pressure which causes the sprinkler to discharge the water at a rate of at least 0.15 gallons per minute per square foot (GPM/ft.$^2$) of the coverage area to be protected and up to a rate of 0.20 GPM/ft.$^2$. In other words, water is supplied at a rate of at least 38.4 gallons per minute for a 16×16 foot coverage area to a rate of at least 48 gallons per minute for a 16×20 foot coverage area.

Figure 7:
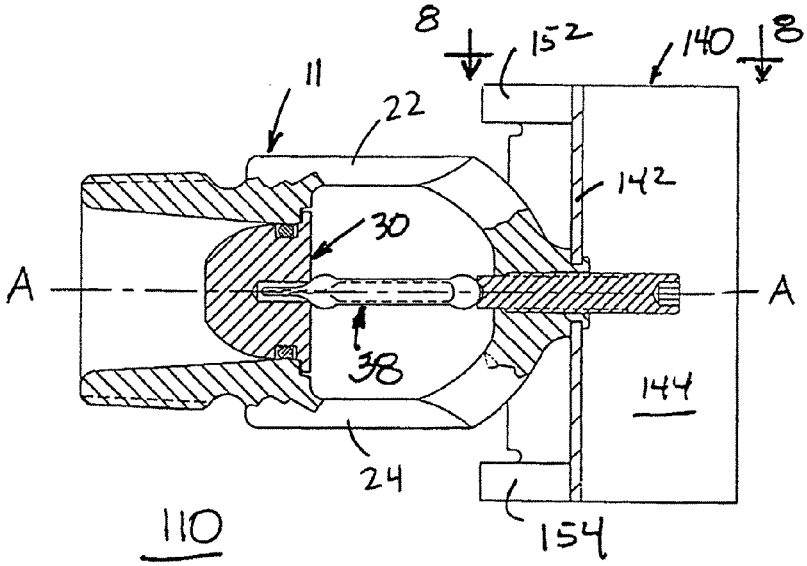
FIG. 7 is a partially broken, bottom view of a second embodiment ordinary hazard sidewall sprinkler according to the present invention.
Figure 8:
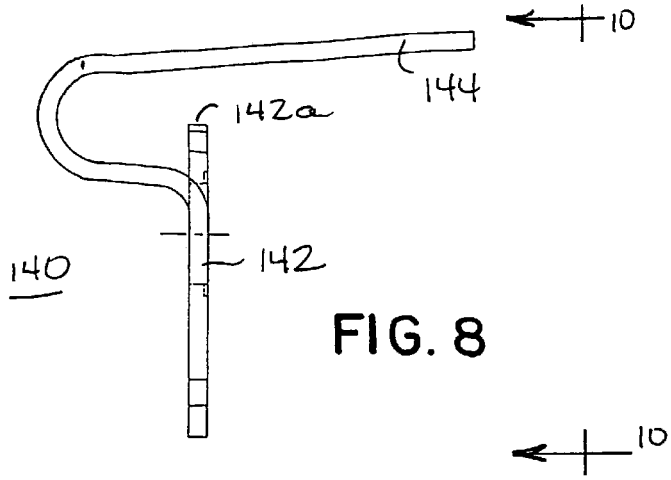
FIG. 8 is an upright side elevational view of the deflector of the sprinkler of FIG. 7 taken along lines 8-8 in FIG. 7 without the sprinkler frame.
Figure 9:
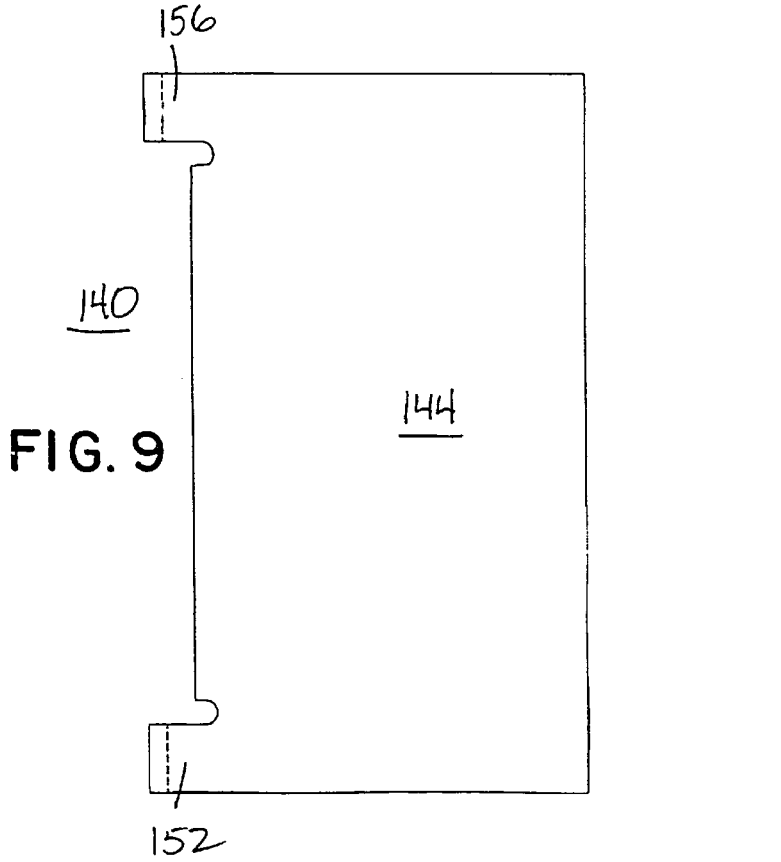
FIG. 9 is a top plan view of the deflector of FIG. 8.
Figure 10:
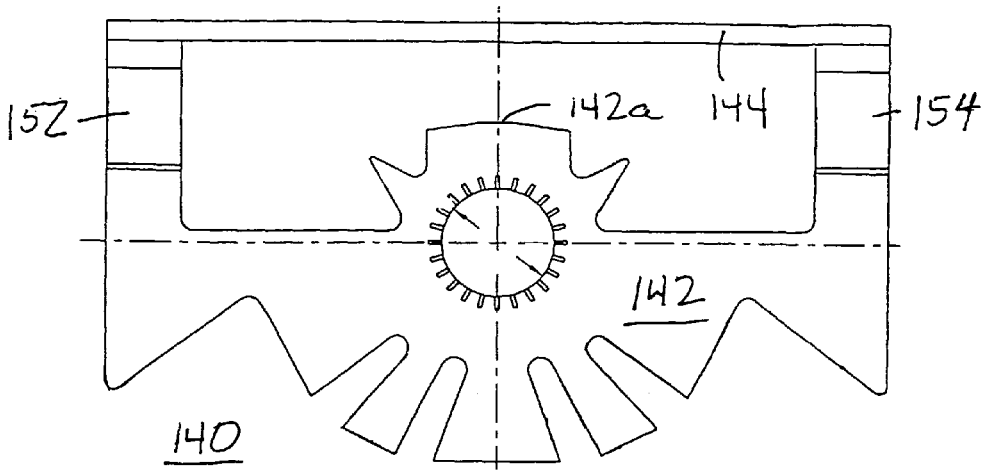
FIG. 10 is a front elevational view of the deflector of FIGS. 8 and 9 taken along the lines 10-10 of FIG. 8.
Figure 11:
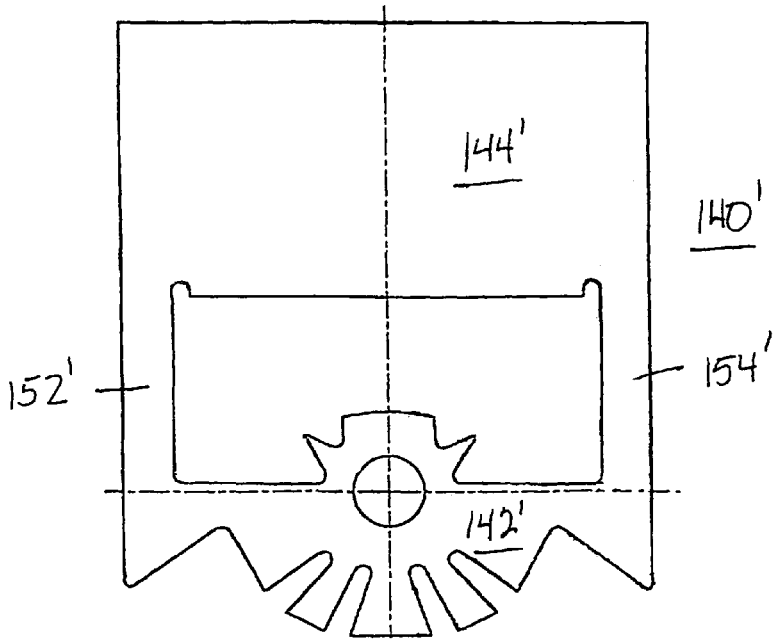
FIG. 11 is a plan view of a planar blank used to form the deflector of FIGS. 8 through 10.

A second deflector 140 for a second preferred embodiment sprinkler 110, which is itself shown in FIG. 7, is shown in FIGS. 8-10. The frame 11, closure 30 and trigger 38 of sprinkler 110 are identical to those of the first sprinkler 10. The blank 140' from which deflector 140 is formed is shown in FIG. 11. Again, the features of deflector 140 and its blank 140' are substantially shown to relative scale with the face portion 142 of the deflector 140 being approximately 1.5 inches wide and the canopy portion 144 being of the same width and about 1.1 inches in length. Sprinkler 110 can control ordinary hazard fires in extended coverage areas of up to sixteen feet wide and up to twenty-four feet long (for example a 16 foot×22 foot to 16 foot×24 foot coverage area) when pressurized to supply water at a rate of at least 0.15 gallons per minute and up to 0.20 GPM for each square foot of such extended coverage area.

Both deflectors 40 and 140 are preferably made from a conventional metallic material such as 90/10 bronze (alloy 220 sheet), approximately 40 mm thick with an RB hardness of 60-70. Blanks are stamped flat from such sheets and bent to final form.

Note that in the second embodiment sprinkler 110, the frame arms 22, 24 are preferably located on either side of central axis A-A to lie in a horizontal plane through central axis A-A generally parallel to the canopy portion 144 of deflector 140. The arms 22, 24 of the first sprinkler embodiment 10 preferably are positioned above and below central axis A-A and lie in a vertical plane through central axis A-A and generally perpendicular to canopy portion 44.

FIGS. 12-14 depict diagrammatically a sidewall sprinkler system utilizing at least a pair of the preferred embodiment, frame-type, ordinary hazard extended coverage sidewall sprinklers 10 and/or 110 of the present invention. Sprinklers 10 and 110 are installed in conformance with national fire sprinkler system installation standards (NFPA Standard 13). Deflectors should be located not less than four inches and not more than six inches from the nearest adjoining wall and ceiling unless special exceptions apply. In particular, each sprinkler 10 or 110 is typically mounted protruding from a flat vertical wall 80 extending between a parallel ceiling 82 and floor 84 by means of a stem 86 branching from a common supply pipe 88 supplying water to other sprinklers of the system. Each sprinkler 10 or 110 is positioned so as to protect a coverage area F within a structure within which the sprinkler 10,110 is installed. Area F is located immediately below and forward of the discharge end 17, 117 of the sprinkler(s) 10, 110. Area F is at least generally rectangular and even may be square (e.g., 16 feet×16 feet) and has a length L, which extents in axial direction away from the outlet 16 and discharge end 17, and a width W, which is perpendicular to the length L. Sprinklers of the present invention provide a generally horizontal spray pattern of water droplets such that each sprinkler effectively covers at least generally rectangular (as opposed to circular) area of more than one hundred square feet in size and is effective in controlling ordinary hazard fires in such area. More particularly, sprinkler 10 of the present invention provides a desired uniform distribution of water in coverage areas of up to 16×20 square feet, while sprinkler 110 provides such a distribution in coverage areas of up to 16×24 square feet when either sprinkler 10, 110 is pressurized to deliver to those areas average water densities of between 0.15 and 0.20 gallons per minute per square foot (GPM/ft$^2$). When an identical pair of sprinklers 10 or 110 of the present invention is installed as indicated in FIGS. 12 through 14 and pressurized as indicated above, they will provide a distribution of water droplets found effective to control ordinary hazard fires in the coverage area F extending away from their discharge end.

For water distribution testing, pairs of the sprinklers 10, 110 are installed at their rated lateral spacing (e.g. 16 feet on center) with the deflector canopy 4½ inches from the lower surface of the ceiling 82 and with the defector face 6 inches from the proximal outer surface of the adjoining vertical wall 80. A collection area is defined beneath and between the two sprinklers at either of two heights: a height of 6 feet 7½ inches below canopy portion 44 or 144 and 36 inches below the canopy portion 44 or 144 of each sprinter 10, 110. See Underwriter's Laboratories, Inc. current UL Standard 199, incorporated by reference herein in its entirety for details of the water distribution test set-up and distribution criteria as well as the fire test (crib) set-up and criteria. It is possible to effectively control ordinary hazard fires without fully complying with the water distribution test criteria but it is believed that a sprinkler which can meet that criteria will, without question, be able to control ordinary hazard fires.

While preferred embodiments of the invention have been described and some possible changes thereto noted, it be appreciated by those skilled in the art that changes could be made to the embodiments described above without departing from the broad inventive concept thereof. It is understood, therefore, that this invention is not limited to the particular embodiments disclosed, but it is intended to cover all modifications within the spirit and scope of the present invention as defined by the appended claims.

The invention claimed is:

1. An extended coverage sidewall automatic fire sprinkler comprising:

a generally tubular body with a central passageway and a central axis, one end of the passageway forming an outlet at one end of the tubular body, a closure at the one end of the tubular body at least essentially generally closing the passageway, a trigger positioned to releasably retain the closure at the outlet closing the passageway, and a deflector at a discharge end of the sprinkler, the deflector being coupled with the tubular body adjoining a yoke, the yoke having a knuckle with a boss, the deflector facing and spaced axially away from the outlet and intersecting the central axis, the tubular body having a K factor greater than 9, the deflector being symmetrical about an imaginary vertical plane passing through the central axis, the deflector including a first arm, a second arm and a generally planar face portion generally orthogonal to the central axis, the face portion having a perimeter that circumscribes a single face portion opening within the perimeter axially aligned with the central axis and engaged with the boss of the knuckle so that the boss extends through the single face portion opening to space the face portion from the outlet, the deflector being further divided by an imaginary horizontal plane passing through the central axis and orthogonal to the vertical plane, the face portion further including an upper edge above the horizontal plane and a lower edge that extends parallel to and below the horizontal plane perpendicular to the vertical plane, the face portion having a bottom center extending below the horizontal plane and centrally axially aligned along the vertical plane with the face portion opening so as to locate the lower edge as a portion of the deflector most remotely below the horizontal plane, the deflector further including a canopy portion spaced from the upper edge so as to define a perimeter of a flow passage through the deflector, the flow passage consisting of a single flow opening in the deflector for fluid to pass the canopy portion being supported by the first and second arms and being coupled to the face portion at a first canopy end and extending generally along the central axis away from the outlet towards a free end, the first canopy end being spaced at a first distance from the outlet, the free end defining a linear profile the entire length from the first arm to the second arm extending parallel to the horizontal plane and spaced from the outlet at a second distance greater than the first distance, and the deflector being shaped and positioned so that upon release of the closure by the trigger, the deflector transforms water discharged horizontally from the outlet into a spray pattern of water droplets dispersed over a generally horizontal, generally rectangularly-shaped extended coverage area of more than one hundred square feet located on one side of the sprinkler effective to control an ordinary hazard fire in the coverage area, and when the sidewall fire sprinkler is paired with an identical sidewall fire sprinkler mounted approximately sixteen feet apart on a generally planar wall surface with a collection area of approximately sixteen feet between the sprinklers and sixteen feet away from one of the sprinklers, the collection area located at either one of a distance of about thirty-six inches and a distance of approximately six feet and 7.5 inches below each of the sidewall fire sprinklers so that water is delivered to the collection area at an average density of at least about 0.15 gallons per minute per square feet.

2. The sprinkler of claim 1, wherein the K factor greater than 9 comprises a K factor of between 10 and 13, both inclusive.

3. The sprinkler of claim 2, claim 1, wherein the K factor greater than 9 comprises a K factor that is between 11 and 12, both inclusive.

4. The sprinkler of claim 1, wherein the trigger is a liquid-filled glass bulb.

5. The sprinkler of claim 1, wherein the coverage area receiving water from said sidewall sprinkler is up to about two hundred and fifty six square feet in size.

6. The sprinkler of claim 1, wherein the coverage area receiving water from said sidewall sprinkler is up to about three hundred and twenty square feet in size.

7. The sprinkler of claim 1, wherein the coverage area is more than three hundred and twenty and up to about three hundred eighty four square feet in size.

8. The sprinkler of claim 1, wherein the coverage area is about three hundred and eighty-four square feet in size.

9. The sprinkler of claim 1, wherein the coverage area is at least sixteen feet by sixteen feet and up to about sixteen feet by twenty four feet.

10. The sprinkler of claim 9, wherein the coverage area is about sixteen feet by eighteen feet in size.

11. The sprinkler of claim 9, wherein the coverage area is about sixteen feet by twenty feet in size.

12. The sprinkler of claim 1, wherein the face portion is positioned facing and spaced axially away from the outlet along the central axis so as to perpendicularly intersect a column of water issuing from the outlet along the central axis and the canopy portion being supported on one side of the face portion spanning the face portion, the canopy portion being generally parallel with the central axis and perpendicular to the face portion, the face portion and canopy portion being configured to deliver water to the coverage area in a density of at least 0.15 and up to about 0.20 gallons per minute/ft$^2$ to achieve a generally planar spray pattern of water droplets generally parallel to a major side of the canopy portion facing the central axis, the spray pattern extending up to about twenty feet beyond the face portion and up to about eight feet to either lateral side of the central axis when the sprinkler is positioned with the central axis horizontal and the major side of the canopy portion facing the central axis being generally horizontal and above the central axis whereby said sprinkler is effective in controlling ordinary hazard fires over the coverage area.

13. The sprinkler of claim 12, wherein the coverage area is at least three hundred and twenty square feet and up to about three hundred eighty four square feet.

14. The sprinkler of claim 1, wherein the canopy portion is oriented generally parallel to the central axis with the sprinkler in a normal operating orientation with the central axis generally horizontal and the canopy portion generally centered over the face portion.

15. The sprinkler of claim 14 wherein the deflector is further configured, with the sprinkler in the normal orientation with the canopy portion generally horizontal and above the face portion of the deflector, to deliver after release of the closure, water supplied through the tubular body at a rate of at least 0.15 and up to about 0.20 gallons per minute per square foot for each square foot of the coverage area, sufficiently uniformly over the coverage area to control an ordinary hazard fire located anywhere within the coverage area with only the supplied water, with the coverage area being more than one hundred square feet and up to about three hundred eighty four square feet and located at a height of only three feet below the canopy portion of the deflector.

16. The sprinkler of claim 15 wherein the coverage area is up to sixteen feet wide and at least sixteen and up to about twenty four feet long.

17. The sprinkler of claim 16 wherein the coverage area is about sixteen feet wide and more than sixteen and up to about twenty-four feet long.

18. The sprinkler of claim 1, wherein the K factor greater than 9 comprises a K factor greater than 9 and up to about 14;

the sprinkler further comprises two frame arms coupled to the generally tubular body proximate the outlet, the two frame arms being located on a plane which intersects the central axis to define the knuckle;

the coverage area is at least two hundred fifty-six and up to about three-hundred eighty four square feet on one side of the sprinkler; and wherein the canopy further having a generally flat planar surface substantially parallel to the plane on which the frame arms are located.

19. The sprinkler of claim 1, wherein the K factor greater than 9 comprises a K factor greater than 9 and up to about 14, and the canopy further having a surface distal to the outlet consisting of a generally flat surface generally perpendicular to the vertical plane.

20. The sprinkler of claim 18 wherein the two frame arms and their plane are parallel to an area to be protected.

21. The sprinkler of claim 19, wherein the first and second arms of the deflector couple the flat canopy and the face portion of the deflector.

22. The sprinkler of claim 19, wherein the first and second arms of the deflector frame the single flow opening through the deflector.

23. The sprinkler of claim 1, wherein the first and second arms of the deflector are spaced apart by about 1.5 inches.

24. The sprinkler of claim 1 wherein the canopy portion comprises a distal surface oriented in one orientation generally parallel to or oblique to the axis and the horizontal plane.

25. The sprinkler of claim 23, wherein the amount of water being discharged is at a density of at least 0.15 and up to about 0.20 gallons per minute per square feet.

26. The sprinkler of claim 25, wherein the amount of water being discharged is at a density of about 0.20 gallons per minute per square feet.

27. The sprinkler of claim 26, wherein the extended-coverage area is greater than 100 square feet and up to about 384 square feet.

28. The sprinkler of claim 26, wherein the water flow from the outlet is at least 38 gallons per minute and up to about 48 gallons per minute.

29. The sprinkler of claim 26, wherein the extended-coverage area includes a length and a width, each of the length and the width being greater than 10 feet and up to about 24 feet.

30. The sprinkler of claim 29, wherein the length and the width being at least 16 feet and up to about 24 feet such that the extended-coverage area is at least 256 square feet and up to about 384 square feet.

31. The sprinkler of claim 30, wherein the extended-coverage area is at least 320 and up to about 384 square feet.

32. The sprinkler of claim 26, wherein the K factor greater than 9 comprises a K factor that is about 11 or greater.

33. The sprinkler of claim 26 wherein the K factor greater than 9 comprises a K factor that is about 14.

34. The horizontal sprinkler of claim 24, wherein the canopy portion including a generally rectangular shaped perimeter having a length along the axis of about 1.1 inches or more and a width orthogonal to the axis of about 1.5 inches or more.

35. The sprinkler of claim 1 wherein the deflector transforms water being discharged from the outlet so as to provide a density of about 0.20 gallons per minute per square feet.

36. The sprinkler of claim 35, wherein the deflector transforms water being discharged from the outlet at a rate of at least 38 gallons per minute and up to about 48 gallons per minute.

37. The sprinkler of claim 1, wherein the K factor greater than 9 comprises a K factor greater than 9 and up to about 14; and the sprinkler further comprises a frame arm being coupled to the end of the generally tubular body, the frame arm being located generally on a horizontal plane, which is generally parallel to an area to be protected.

38. The sprinkler of claim 1, wherein the K factor greater than 9 comprises a K factor greater than 9 and up to about 14;

the sprinkler further comprises a frame arm being coupled to the end of the generally tubular body, the frame arm being located generally on a vertical plane, which is generally perpendicular to an area to be protected; and wherein the canopy further has a surface distal to the outlet and generally parallel to the longitudinal axis above an area to be protected, the distal surface consisting of a generally flat surface generally perpendicular to the vertical plane passing through the longitudinal axis.

39. The sprinkler of claim 1, wherein the K factor greater than 9 comprises a K factor greater than 9 and up to about 14, and the trigger is a heat responsive trigger that retains the closure to occlude the passageway until actuation of the trigger.

40. The sprinkler of claim 1, wherein the K factor greater than 9 comprises a K factor greater than 9 and up to about 14, and the first and second arms of the deflector defining the single flow opening have a distance of about 1.5 inches between proximal surfaces of the first and second arms.

41. The sprinkler according to claim 40, wherein the deflector transforms water at a rate of at least 38 and up to about 48 gallons per minute discharged horizontally from the outlet at a density of at least 0.15 and up to about 0.20 gallons per minute per square feet over the extended-coverage area.

42. The sprinkler of claim 1, wherein the canopy portion comprises a surface distal to the central axis, the distal surface consisting of a generally flat surface parallel to the central axis.

43. The sprinkler of claim 1 the yoke further comprising a frame arm being coupled to the one end of the generally tubular body; and the sprinkler further comprising a liquid-filled glass bulb positioned to releasably retain the closure at the outlet closing the passageway.

* * * * *